US006938427B1

(12) United States Patent
Wood

(10) Patent No.: US 6,938,427 B1
(45) Date of Patent: Sep. 6, 2005

(54) SYSTEMS AND METHODS FOR CLOSED SYSTEM COOLING

(75) Inventor: Bob Wood, Oakfield, GA (US)

(73) Assignee: Advanced Cooling Technologies, LLC, Oakfield, GA (US)

( * ) Notice: Subject to any disclaimer, the term of this patent is extended or adjusted under 35 U.S.C. 154(b) by 0 days.

(21) Appl. No.: 10/830,753

(22) Filed: Apr. 23, 2004

Related U.S. Application Data

(63) Continuation of application No. 10/375,688, filed on Feb. 27, 2003, now abandoned.

(51) Int. Cl.[7] ..... F25B 7/00
(52) U.S. Cl. ..... 62/79; 62/335; 62/434
(58) Field of Search ..... 62/79, 335, 434, 62/435

(56) References Cited

U.S. PATENT DOCUMENTS 5,044,172 A * 9/1991 Inoue et al. ..... 62/335
5,335,508 A * 8/1994 Tippmann ..... 62/129
5,351,502 A * 10/1994 Gilles et al. ..... 62/238.7
6,148,634 A * 11/2000 Sherwood ..... 62/434
6,205,795 B1 * 3/2001 Backman et al. ..... 62/79
6,330,809 B1 * 12/2001 Boardman et al. ..... 62/434
6,494,054 B1 * 12/2002 Wong et al. ..... 62/335

* cited by examiner

*Primary Examiner*—William E. Tapolcai
(74) *Attorney, Agent, or Firm*—Kilpatrick Stockton LLP

(57) ABSTRACT

This invention is directed to systems, apparatuses and methods for reducing the temperature of a condenser fluid, used in a condenser in an air conditioning system to cool a compressed refrigerant, without releasing fluids to the environment. These systems include a first heat exchanger for reducing the temperature of a condenser fluid using a coolant fluid, a second heat exchanger for reducing the temperature of the coolant fluid using a refrigerant and a cooling system for reducing the temperature of the refrigerant. Theses systems do not release fluids into the environment, which is common when conventional evaporative cooling towers are used to reduce the temperature of condenser fluids.

12 Claims, 13 Drawing Sheets

SYSTEMS AND METHODS FOR CLOSED SYSTEM COOLING

This application is a continuation of U.S. application Ser. No. 10/375,688 filed Feb. 27, 2003, now abandoned.

RELATED FIELDS

This invention relates to systems, apparatuses and methods for replacing evaporative cooling towers in large capacity air conditioning systems, and more particularly, for reducing the temperature of condenser fluids used in condensers of air conditioning systems without releasing fluids into the environment.

BACKGROUND

Many large scale air conditioning systems rely on evaporative cooling towers as an integral means for removing heat from the air located within a building. Generally, air conditioning systems operate by passing air or liquid over coils through which a cold refrigerant, such as freon, flows. The refrigerant is cooled by first compressing the refrigerant in a gaseous state. Compressing the refrigerant causes the temperature of the refrigerant to rise. The refrigerant is then cooled by sending the compressed gas through a condenser. The compressed refrigerant condenses from a gaseous state into a liquid state as the temperature of the gas is reduced. The pressurized liquid is then sent through an expansion valve, which causes the refrigerant to evaporate and cool rapidly. Depending on the configuration of the system, either a gas, such as air, or a fluid, such as water, is cooled by contacting the coils through which the cold refrigerant flows. The cooled air or fluid is then circulated through a building to cool the air contained in the building.

The stage in which the refrigerant is cooled and condensed is typically conducted in a condenser. Often, but not always, the condenser is a heat exchanger having a plurality of tubes through which the refrigerant flows. The tubes are contained in a chamber through which a fluid, such as water or other coolants, flow. The fluid passes through the chamber and contacts the outside surface of the tubes through which the refrigerant flows. The fluid picks up heat from the tubes and is then circulated through a cooling tower to cool the fluid. Typically, the fluid must be pumped from the basement or boiler room of a building to the roof of a building, which may be more than 100 stories from the basement in the largest of buildings in the United States. The fluid is passed through an evaporative cooling tower, located on the roof, which cools the fluid. The cooling tower operates by forcing air across the fluid, which is typically water, as the water is dispersed through the cooling tower. A portion of the fluid evaporates, thereby cooling the fluid by taking heat from the fluid and releasing it into the air. The cooled fluid is then returned to the condenser through a conduit.

While a cooling tower increases the efficiency of a cooling system and has been in use for years, a cooling tower requires considerable maintenance to keep the unit in an operable condition. For instance, algae, slime forming bacteria, fungi and other microorganisms often form on baffles of a cooling tower that are used to disperse the hot water as the water flows past fans blowing air. The algae reduces the efficiency of the cooling tower and can clog the flow of water through various parts of a water tower. Currently, this problem is overcome by regularly removing the algae from the baffles and other parts of the water tower and by adding chemicals to the water on a regular basis to combat the algae and other growth.

Another problem that occurs in a cooling tower is the development of scale deposits. Scale deposits occur when solids and gases in a cooling tower reach their capacity of solubility and precipitate out onto piping and heat transfer surfaces. As the scale deposits on heat transfer surfaces, the ability of the cooling tower water to absorb heat is reduced. Scale deposits have been treated using chemicals. However, while chemicals allow a particular volume of water to hold a greater amount of particles, a point is reached where the water must be removed from the system and replaced, which is often referred to as bleeding the system. Because this water often contains chemicals, it must be disposed of in accordance with applicable environmental regulations, which can be very expensive.

A cooling tower relies on the evaporative cooling process to cool water by pulling heat from the water. The evaporative process causes considerable water loss from the water flowing through the cooling tower. Thus, in order to maintain the system in an operating condition, water must continuously be added to the system. In dry geographic areas and areas in which water is in short supply, water may be not be readily available in the amount needed. In fact, it is not improbable that some areas may even prohibit the use of water towers in the near future because of ever increasing political pressures to conserve water resources.

Thus, a need exists for a system for cooling a condenser fluid in an air conditioning system that does not rely on an external water source.

SUMMARY

Various embodiments of this invention are directed to systems, apparatuses and methods for reducing the temperature of a fluid used in a condenser of an air conditioning system, and more particularly, various embodiments of this invention is directed to the temperature reduction of a fluid used in a condenser using a closed system whereby fluids used in the system are not lost to the environment and do not require constant replenishing.

Various embodiments of the present invention include a condenser fluid cooling system that includes a condenser fluid cooling chamber for reducing the temperature of the condenser fluid using a coolant fluid, a coolant fluid cooling chamber for reducing the temperature of the coolant fluid using a refrigerant, and a cooling system for reducing the temperature of the refrigerant. The condenser fluid cooling chamber may be composed of any device capable of reducing the temperature of a condenser fluid used in a condenser without allowing fluids to escape to the environment. In one embodiment, the condenser fluid cooling chamber is a multi-pass, multiple concentric tube-style heat exchanger. The condenser fluid cooling chamber may include a plurality of inner coolant fluid tubes positioned in a plurality of outer condenser fluid tubes. The condenser fluid cooling chamber may be configured to pass a coolant fluid through the lumens of the inner coolant fluid tubes and a condenser fluid through the spaces between the outside surfaces of the inner coolant fluid tubes and the inner surfaces of outer coolant fluid tubes. Thus, the condenser fluid cooling chamber may be configured to maximize the surface area by which conduction between a condenser fluid and a coolant fluid may occur.

In various embodiments, the coolant fluid cooling chamber receives the coolant fluid from the condenser fluid cooling chamber and reduces the temperature of the coolant fluid by passing the coolant fluid across the outside surface of a plurality of tubes containing a cold refrigerant. The coolant fluid cooling chamber may be configured as a dual-pass heat exchanger with the coolant fluid entering the coolant fluid cooling chamber and flowing generally in an upwards vertical direction to the top of the coolant fluid cooling chamber and then flowing generally downward to an exit valve. While flowing through this flow path, the coolant fluid contacts a plurality of tubes containing a cold refrigerant. The tubes may be positioned generally horizontal and perpendicular to the flow of the coolant fluid. The refrigerant may be received from a cooling system, sent through the coolant fluid cooling chamber to reduce the temperature of the coolant fluid, and returned to the cooling system so that the refrigerant may be cooled once again.

In some embodiments, the cooling system may be composed of any device capable of reducing the temperature of the refrigerant. In one embodiment, the cooling system is composed of at least one compressor, at least one condenser, and at least one expansion valve. The compressor may compress the refrigerant, which may increase the pressure and temperature of the refrigerant. The compressed refrigerant is then sent through the condenser which reduces the temperature of the refrigerant and causes the refrigerant to change from a gas to a liquid. The refrigerant may then be passed through the expansion valve which further reduces the temperature of the refrigerant. The relatively cold refrigerant may then be sent to the coolant fluid cooling chamber to reduce the temperature of the coolant fluid.

In some embodiments, the condenser used in the cooling system may be an air-cooled condenser using a plurality of tubes and fins to cool the refrigerant with convection. In one embodiment, an air cooler may be used to cool the ambient air before it is passed across the fins and tubes of the condenser. The air cooler may be composed of one or more drift eliminators using water trickling down through the honeycomb shaped structure to cool the air flowing through drift eliminators. In some embodiments, an additional drift eliminator may be used to capture any water that may pass through the other dirft eliminators. The cooled air may then be passed over the condenser to increase the efficiency of the condenser.

An advantage of various embodiments of this invention is that it does not require that the cooling fluids of a condenser cooling system be replenished during operation because the system does not lose fluids. In contrast, some conventional evaporative cooling towers having initial volumes of 6,000 gallons of cooling fluids with an ambient air temperature of 90 degrees Fahrenheit (F) requires 14,000 gallons of fluid be added to achieve a change of 10 degrees F. of the condenser water flowing through the cooling towers over a 10 hour operating period. Thus, certain embodiments of this invention are more efficient than previous systems.

Another advantage of various embodiments of this invention is that no fluids are expelled into the environments as a byproduct, such as a mist or otherwise; thus, eliminating health hazards associated with conventional cooling towers.

Yet another advantage of various embodiments of this invention is that the fluids used in this invention do not contain harmful chemicals to combat algae growth and other microorganisms because the flow paths are closed and do not provide a favorable environment for their growth; thus, the fluids used in this invention do not pose a health threat when disposed, if needed.

Still another advantage of various embodiments of this invention is that many elements of this invention can be positioned near the condenser and are not required to be mounted to a roof, which may be many stories from the location of the condenser; thus, fewer materials, such as piping and pumps, are need to operate this invention as compared with a conventional cooling tower.

Another advantage of various embodiments of this invention is that no maintenance is required to keep the heat exchangers of this invention operating correctly.

These and other features and advantages of various embodiments of the present invention will become apparent after review of the following drawings and detailed description of the disclosed embodiments.

DETAILED DESCRIPTION OF THE DRAWINGS

Certain embodiments of this invention relate to systems, apparatuses and methods for extracting heat from a fluid used to reduce the temperature of a refrigerant in a condenser in an air conditioning system. Various embodiments of this invention include a plurality of closed loop systems that do not lose water to the environment and, thus, do not require constantly replenishing of the cooling fluids. Many large scale air conditioning systems currently rely on cooling towers to reduce the temperature of liquids used in condensers and waste large volumes of water. However, as described above, cooling towers are riddled with problems. Certain embodiments of this invention eliminate those problems by eliminating the need for a cooling tower in large scale cooling systems. Even so, this invention is not limited to application to large scale cooling systems, but may be used with cooling systems of any size.

Figure 1:
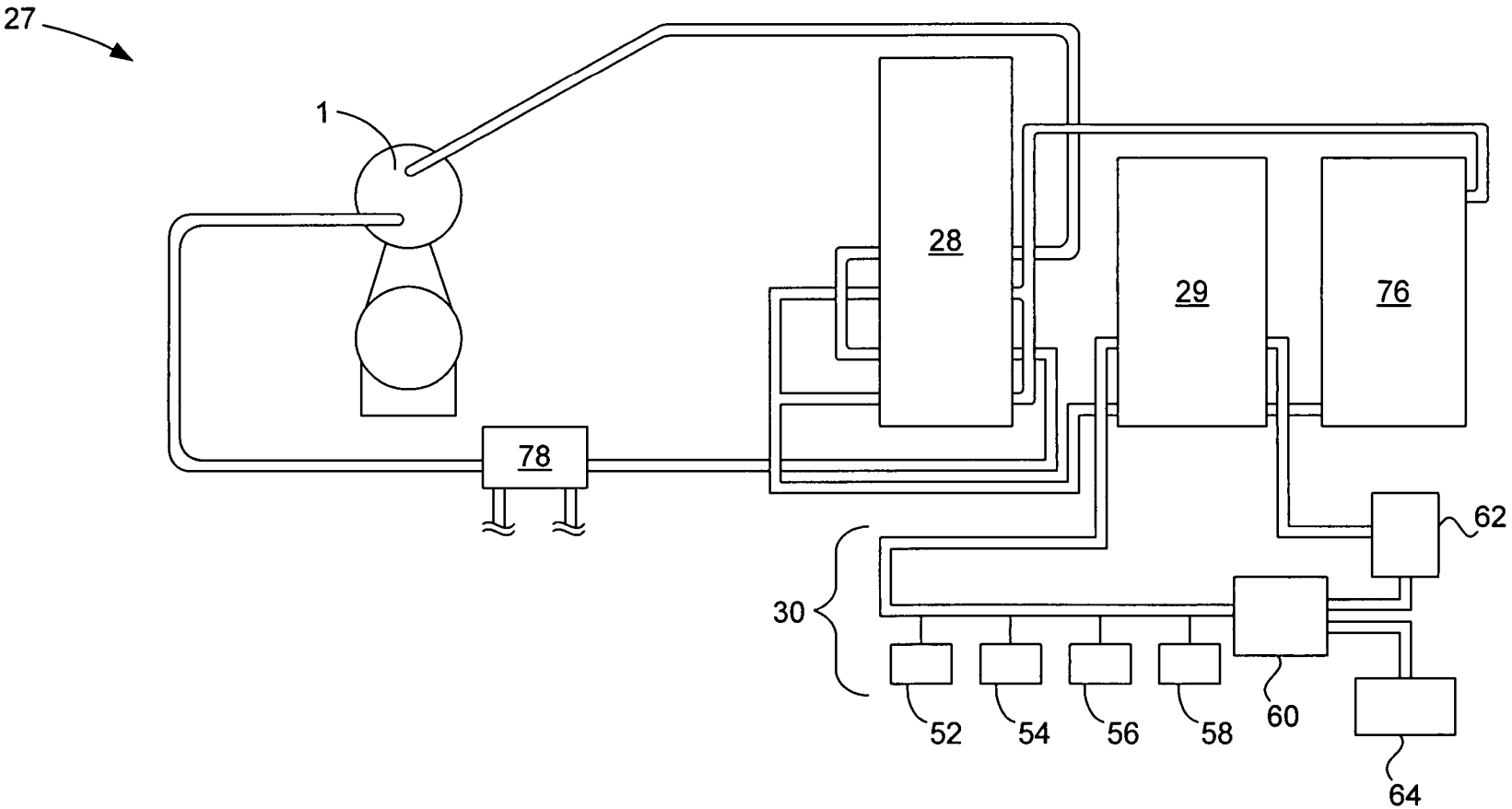
FIG. 1 is a schematic diagram of a typical condenser water cooling system according to an embodiment of this invention.

In the embodiment shown in FIG. 1, a condenser fluid cooling system 27 includes a condenser fluid cooling chamber 28, a coolant fluid cooling chamber 29, and at least one cooling system 30 for cooling the coolant fluid used to cool the condenser fluid. Condenser fluid cooling system 27 receives a condenser fluid, such as water or other fluid, from a condenser 1 in an air conditioning system and reduces the temperature of the fluid by extracting heat from the fluid through conduction. Condenser fluid cooling system 27 operates without losing fluids to the atmosphere, which typically occurs while using conventional evaporative cooling towers.

I. Overview

In the embodiment shown in FIG. 1, condenser fluid cooling system 27 receives condenser fluid from a condenser 1 of an air conditioning system or other cooling system. The condenser fluid may be any conventional coolant fluid or other coolant fluid. In one embodiment, the condenser fluid is a mixture of distilled water, about 20 parts per million (ppm) of polymer AO4 55, about 15 ppm of amphoteric 400, about 10 ppm of tolytriazole, and about 10 ppm of cobratec 926. However, the amounts and types of these constituents may be varied. The temperature of the condenser fluid is reduced by passing the condenser fluid through a plurality of tubes concentrically arranged with respect to coolant fluid tubes, or vice versa. The condenser fluid having a reduced temperature is then returned to the condenser 1. The coolant fluid is sent from the condenser fluid cooling chamber 28 to the coolant fluid cooling chamber 29 to reduce the temperature of the coolant fluid.

In the coolant fluid cooling chamber 29, the coolant fluid is placed in contact with a plurality of tubes through which a cold refrigerant flows. The coolant fluid may be any conventional coolant fluid or other coolant fluid. In one embodiment, the coolant fluid is a mixture of distilled water, about 20 parts per million (ppm) of polymer AO4 55, about 15 ppm of amphoteric 400, about 10 ppm of tolytriazole, and about 10 ppm of cobratec 926. However, the amounts of these constituents may be varied. The cold refrigerant extracts heat from the coolant fluid, thereby reducing the temperature of the coolant fluid. The coolant fluid having a reduced temperature is then returned to the condenser fluid cooling chamber 28, and the refrigerant is sent from the coolant fluid cooling chamber 29 to a cooling system 30.

Figure 9:
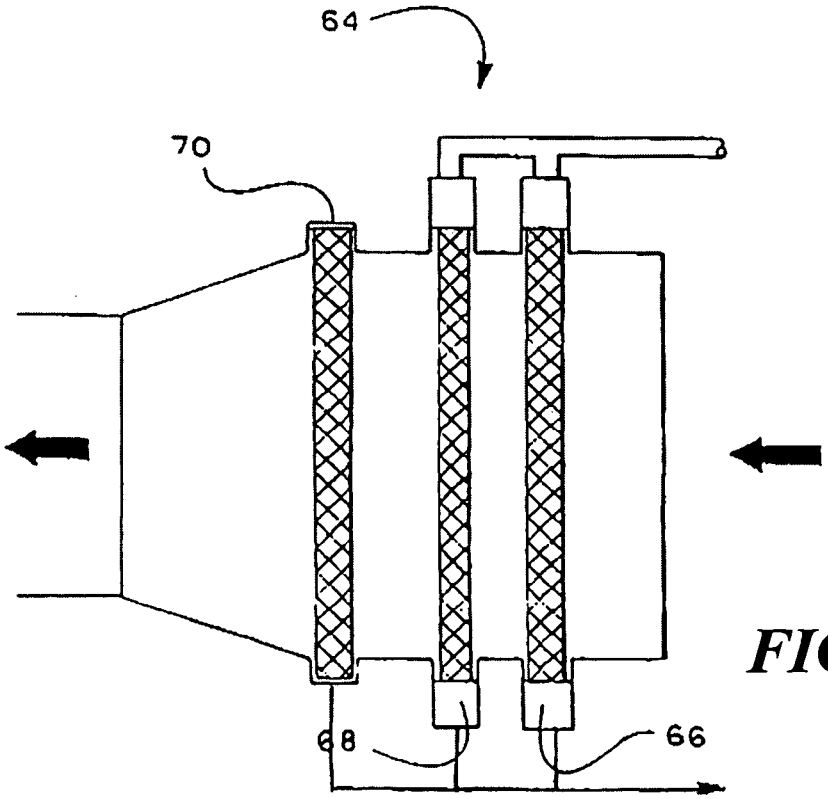
FIG. 9 is a side view of an air cooler usable in the condenser water cooling system of certain embodiments of this invention.

Cooling system 30 may be configured using many different embodiments. For instance, in one embodiment, cooling system 30 includes at least one compressor for receiving the refrigerant from the coolant fluid cooling chamber 29. The compressor compresses the refrigerant, which causes the temperature of the refrigerant to rise. The compressed refrigerant is then passed through at least one condenser to reduce the temperature of the refrigerant and to condense the compressed gas into a liquid. The at least one condenser may be an air-cooled condenser, which operates by passing cooled air across the fins and tubes containing the refrigerant to change the state of the refrigerant. Cooling system 30 may also include an air cooler 64, as shown in FIG. 9, to reduce the temperature of the air used to cool the refrigerant in the condenser by passing the air through the condenser. The pressurized liquid is then sent through an expansion valve, which greatly reduces the temperature of the refrigerant. The cold refrigerant is then returned to the coolant fluid cooling chamber 29 to reduce the temperature of the coolant fluid.

In some embodiments, fluid cooling system 27 may include a pre-chiller 78, as shown in FIG. 1. Pre-chiller 78 may use chilled water to lower the temperature of condenser fluid prior to entering the condenser fluid cooling chamber.

II. Condenser Fluid Cooling Chamber

The condenser fluid cooling chamber 28 reduces the temperature of a condenser fluid used to cool a refrigerant in large scale air conditioning units, which may have capacities of, for example, about 50 tons, 100 tons, 500 tons, or other capacities. Condenser fluid cooling chamber 28 may have many configurations for reducing the temperature of the condenser fluid using a coolant fluid.

Figure 2:
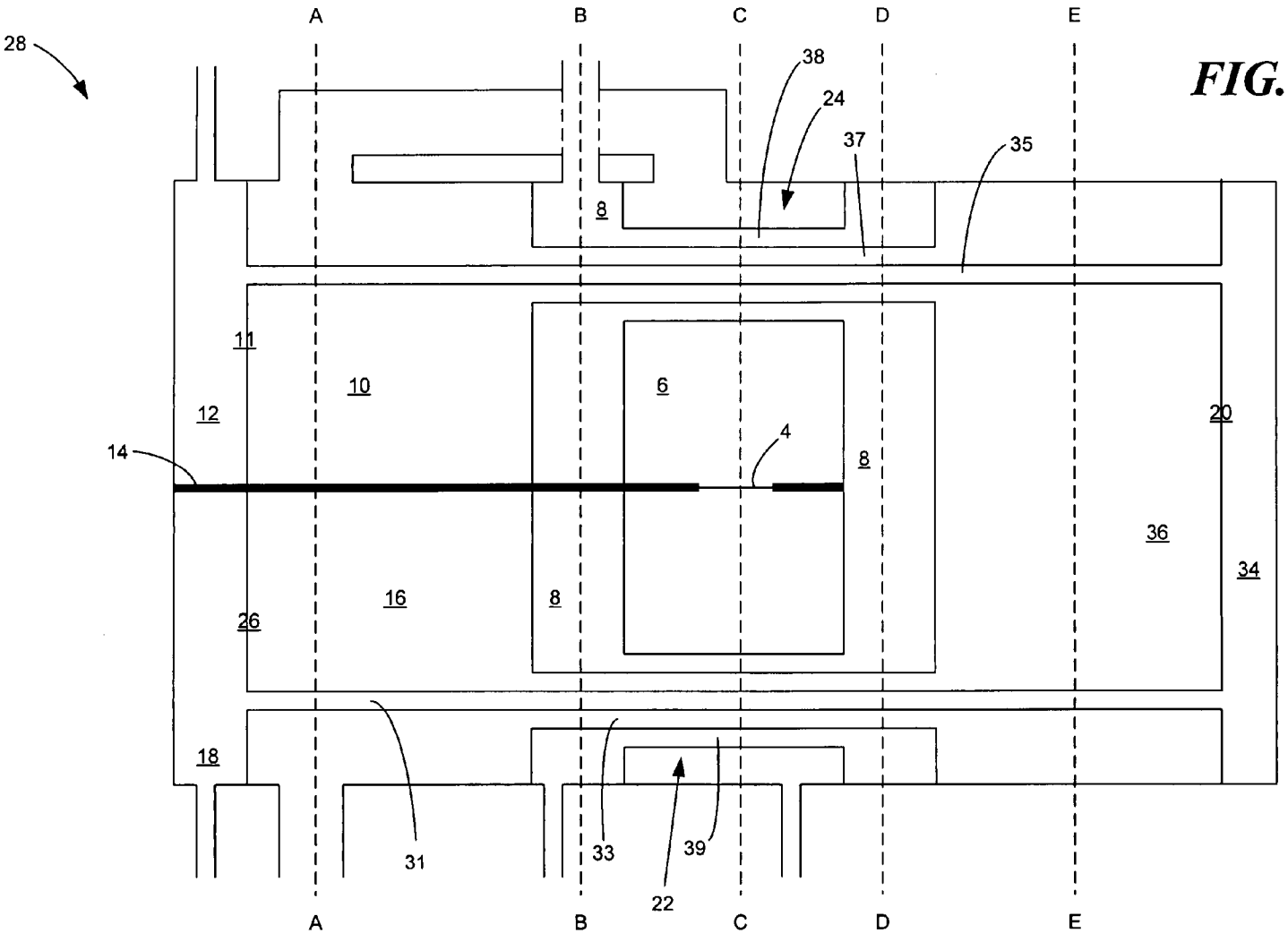
FIG. 2 is a top view of a condenser water cooling chamber usable in a condenser water cooling system in accordance with an embodiment of this invention.
Figure 3:
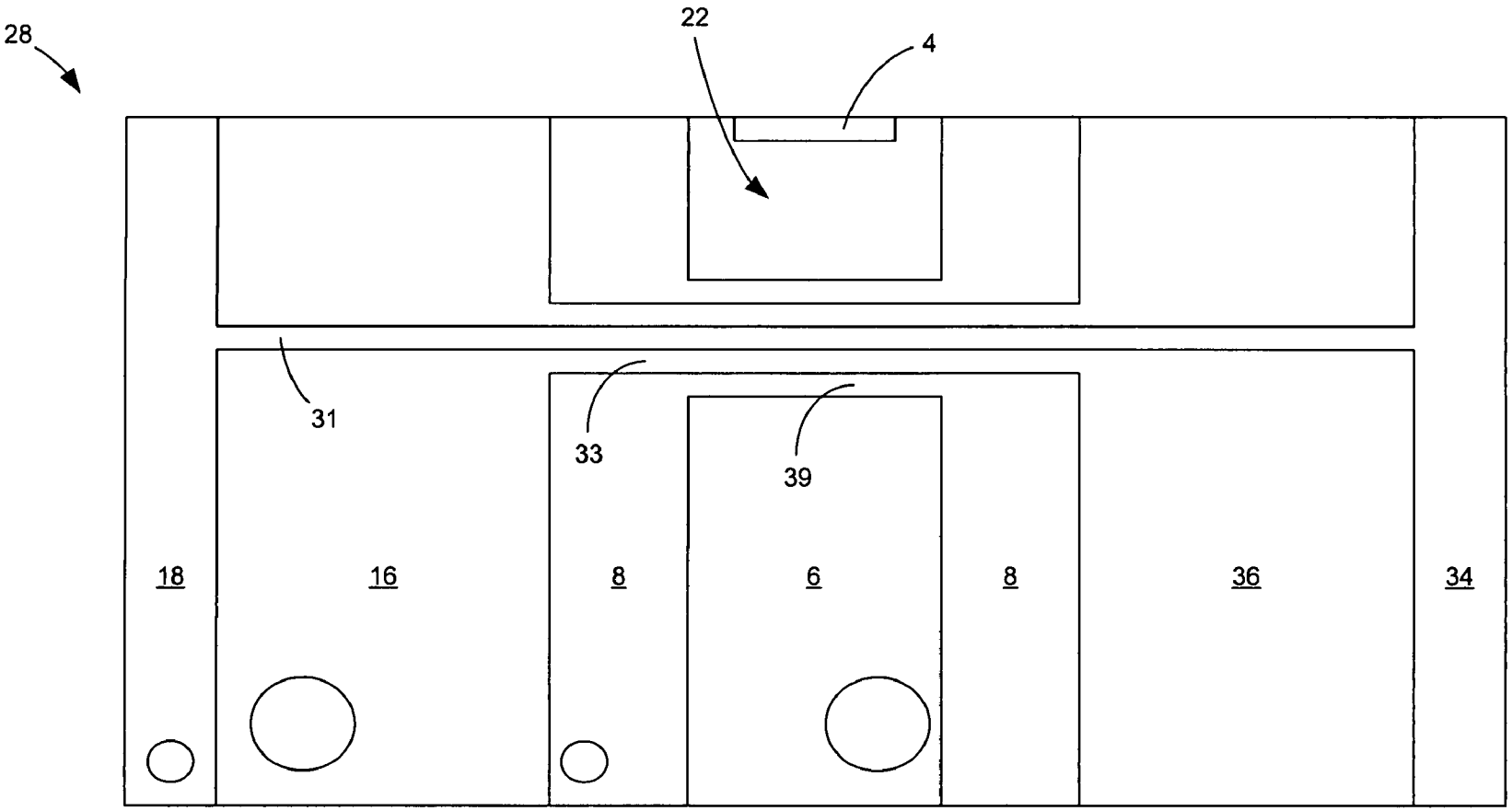
FIG. 3 is a side schematic view of the condenser water cooling chamber shown in FIG. 2.

In the embodiment shown in FIG. 2, the condenser fluid cooling chamber 28 is a multi-pass heat exchanger composed of a plurality of concentric tubes. However, the present invention does not require a condenser fluid cooling chamber of a particular structure or form. Any suitable heat-exchanger may be used.

The condenser fluid cooling chamber 28 may include a first header 22 and a second header 24. First and second headers 22 and 24 may be partially separated from each other by baffle 14. Generally, headers 22 and 24 provide a point of transition for the cooling fluids. In one embodiment designed to function with an air conditioning system having a 100 ton capacity, each header 22 and 24 may have a capacity of about 480 gallons. However, the size of headers 22 and 24 may vary depending on the desired capacity.

First header 22 includes input chamber 26 and intermediate chamber 20. Input chamber 26 is further divided into two sections, a first coolant fluid chamber 18 for receiving coolant from the coolant fluid cooling chamber 29 or coolant storage tank 76, and a first condenser fluid chamber 16 for receiving condenser fluid from a condenser. Intermediate chamber 20 is further divided into second coolant fluid chamber 34 and second condenser fluid chamber 36. Second header 24 includes intermediate chamber 20 as well as output chamber 11, which is further divided into third coolant fluid chamber 12 and third condenser fluid chamber 10.

First and second coolant fluid chambers 18 and 34 are coupled together with tubes, referred to as a first set of coolant fluid tubes 31, through which a coolant fluid can flow. Although only one coolant fluid tube 31 is illustrated in FIG. 2, in one embodiment, there are 931 tubes having inside diameters (I.D.) of about 1½ inches and lengths of about 16 feet. However, the invention is not limited to this particular number, size, or length of tubes, but may be composed of any number, size, or length of tubes.

Figure 4:
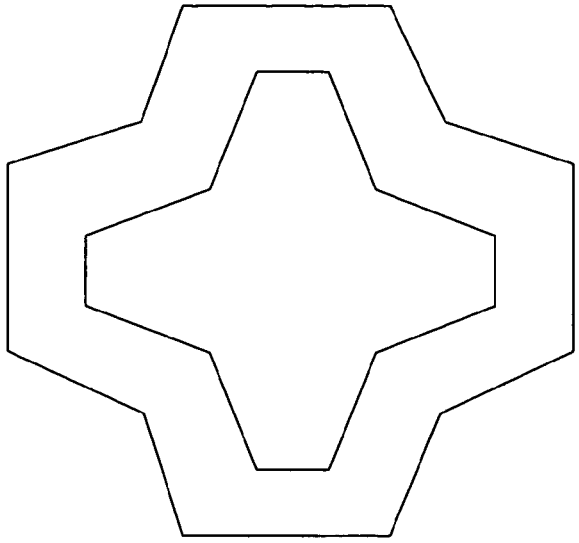
FIG. 4 is a cross-sectional view of a coolant fluid tube positioned concentrically within a condenser fluid tube in accordance with an embodiment of the present invention.
Figure 5:
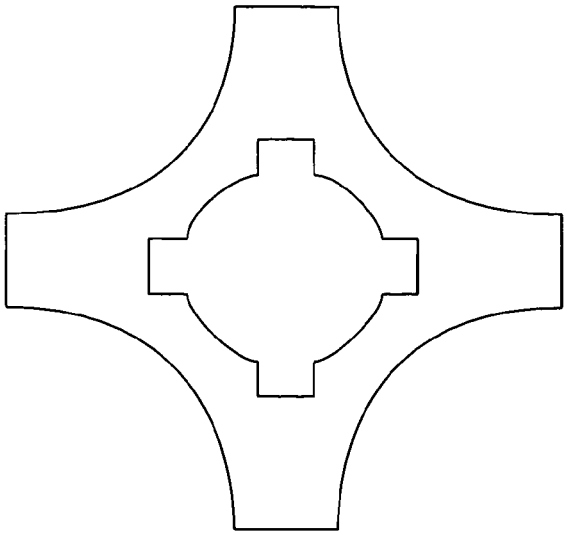
FIG. 5 is a cross-sectional view of another embodiment of a coolant fluid tube positioned concentrically within a condenser fluid tube in accordance with an embodiment of the present invention.

First and second condenser fluid chambers 16 and 36 are coupled together with tubes, referred to as a first set of condenser fluid tubes 33, having an inside diameter of about 3 inches and a length of about 6 feet. The number of 3 inch I.D. tubes is typically equal to the number of 1½ inch I.D. tubes. Each condenser fluid tube 33 is positioned around a coolant fluid tube 31, forming a generally concentric formation. The coolant fluid tubes 31 and the condenser fluid tubes 33 may have a star shaped cross-section, as shown in FIG. 4, or a rounded cross shape, as shown in FIG. 5, which maximize the amount of surface area through which heat transfer may occur. In other embodiments, coolant fluid tubes and condenser fluid tubes may have circular, rectangular, polygonal, or other shaped cross-sections. Further, coolant fluid tubes and condenser fluid tubes do not necessarily need to have identical shaped cross-sections. Instead, the coolant fluid tubes and the condenser fluid tubes may have different shaped cross-sections.

Output chamber 11 of second header 24 is divided into two sections in a fashion similar to input chamber 26. Output chamber 11 includes a third coolant fluid chamber 12 and a third condenser fluid chamber 10. Third coolant fluid chamber 12 is coupled to second coolant fluid chamber 34 with a second set of coolant fluid tubes 35 having an inside diameter of about 1½ inches and a length of about 16 feet. Although only one tube 35 is illustrated in FIG. 2, preferably 931 tubes are used. However, the invention is not limited to this particular number, size, or length of tubes, but may be composed of any number, size, or length of tubes. Third condenser fluid chamber 10 is coupled to second condenser fluid chamber 36 with a second set of condenser fluid tubes 37 having an inside diameter of about 3 inches and a length of about 6 feet. In one embodiment, 931 tubes are used. However, the number, size and length of the tubes may vary based on the required capacity. The coolant fluid tubes 35 are positioned generally concentrically within the condenser fluid tubes 37 in the same configuration as described above. Third coolant chamber 12 is coupled to coolant fluid cooling chamber 29.

Coolant fluid enters fourth coolant fluid chamber 8 from coolant fluid chamber 29. Coolant fluid chamber 8 contains the first and second sets of coolant fluid tubes 31 and 35 and condenser fluid tubes 33 and 37. However, in some embodiments of the present invention, in conditions requiring less cooling such as when the ambient temperature is lower, a valve may prevent coolant from entering fourth coolant fluid chamber 8. Portions of fourth coolant fluid chamber 8 are connected by third and fourth sets of coolant fluid tubes 38 and 39. Fourth coolant fluid chamber 8 is partially divided by baffle 14. By sending the coolant fluid through fourth coolant fluid chamber 8, the coolant fluid contacts the outside surface of condenser fluid tubes 33 and 37, which allows the coolant fluid to receive additional heat from the condenser fluid flowing through the condenser fluid tubes 33 and 37.

Figure 13:
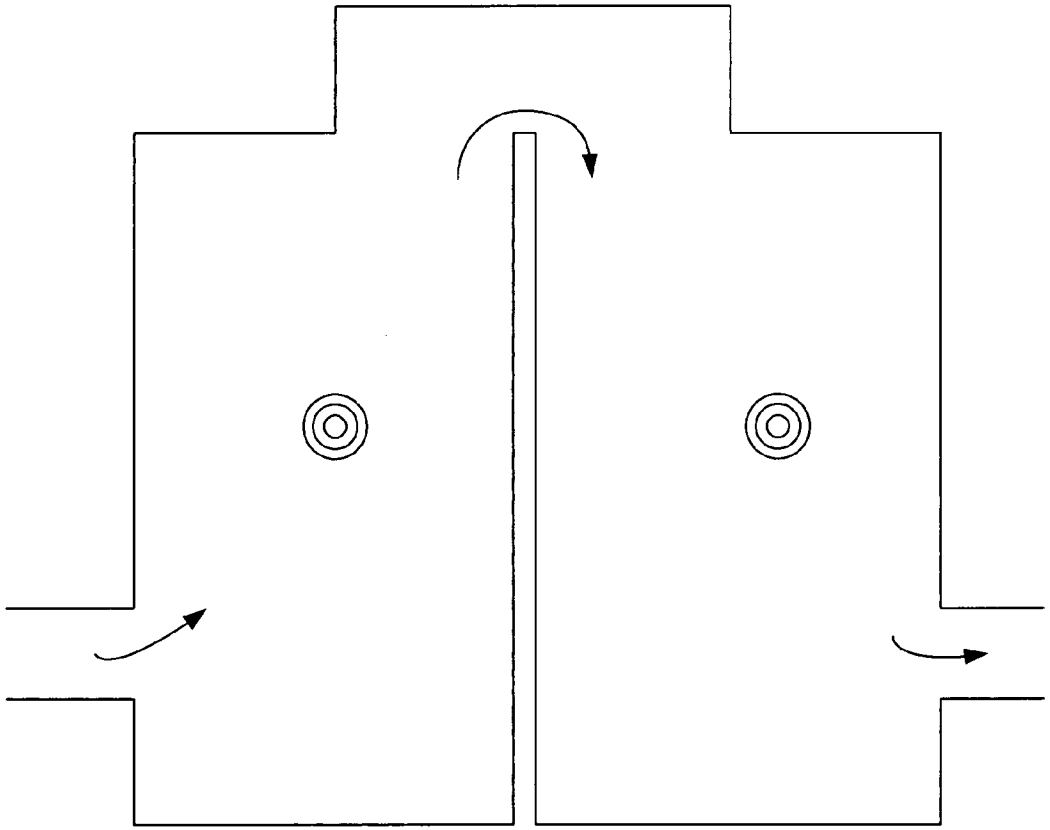
FIG. 13 is a schematic cross section diagram taken along the line C—C in FIG. 2.
Figure 14:
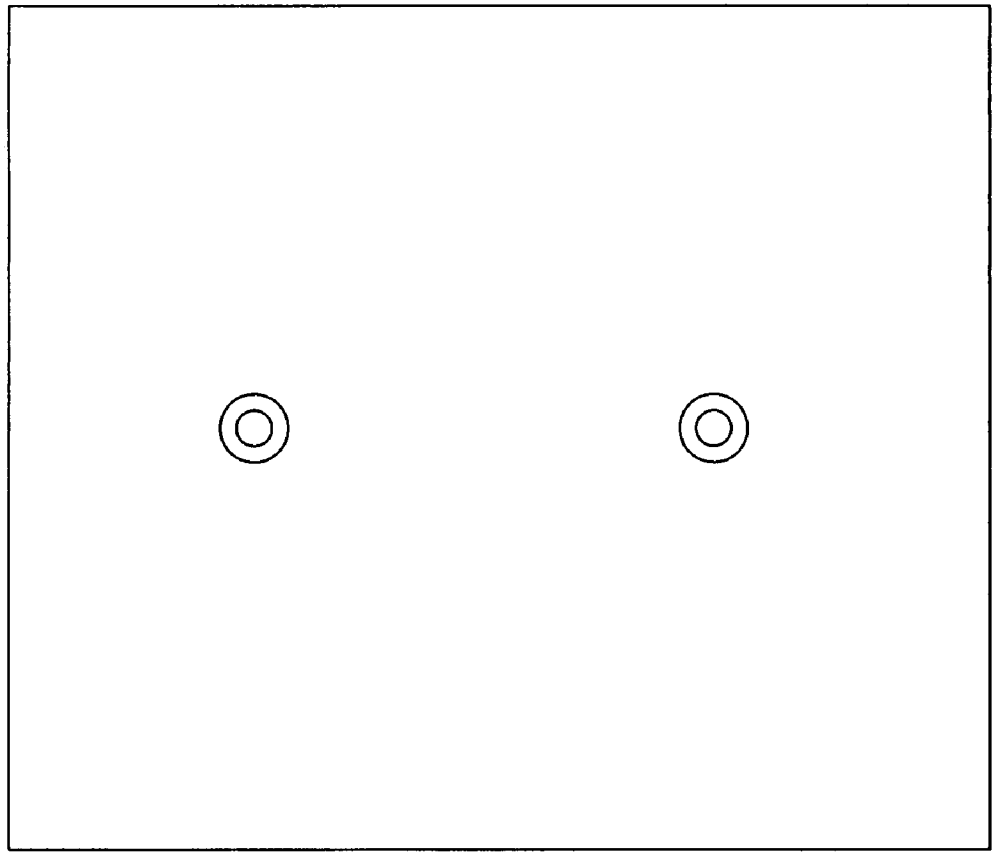
FIG. 14 is a schematic cross section diagram taken along the line D—D in FIG. 2.
Figure 15:
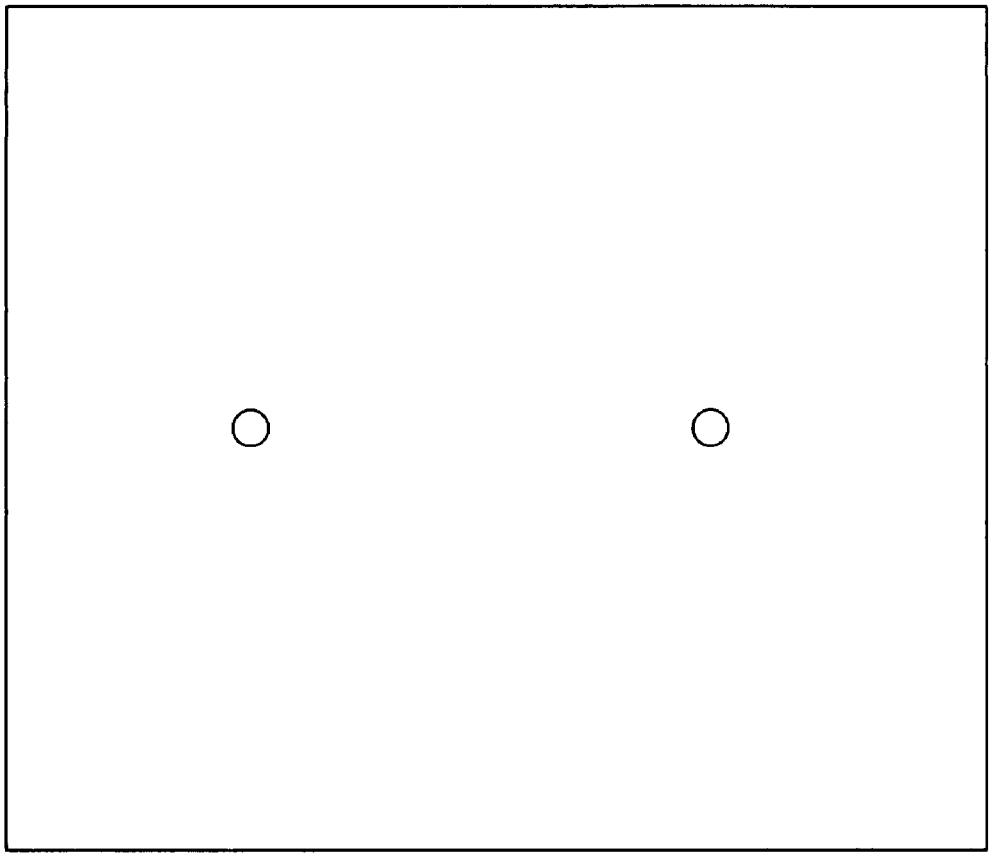
FIG. 15 is a schematic cross section diagram taken along the line E—E in FIG. 2.
Figure 16:
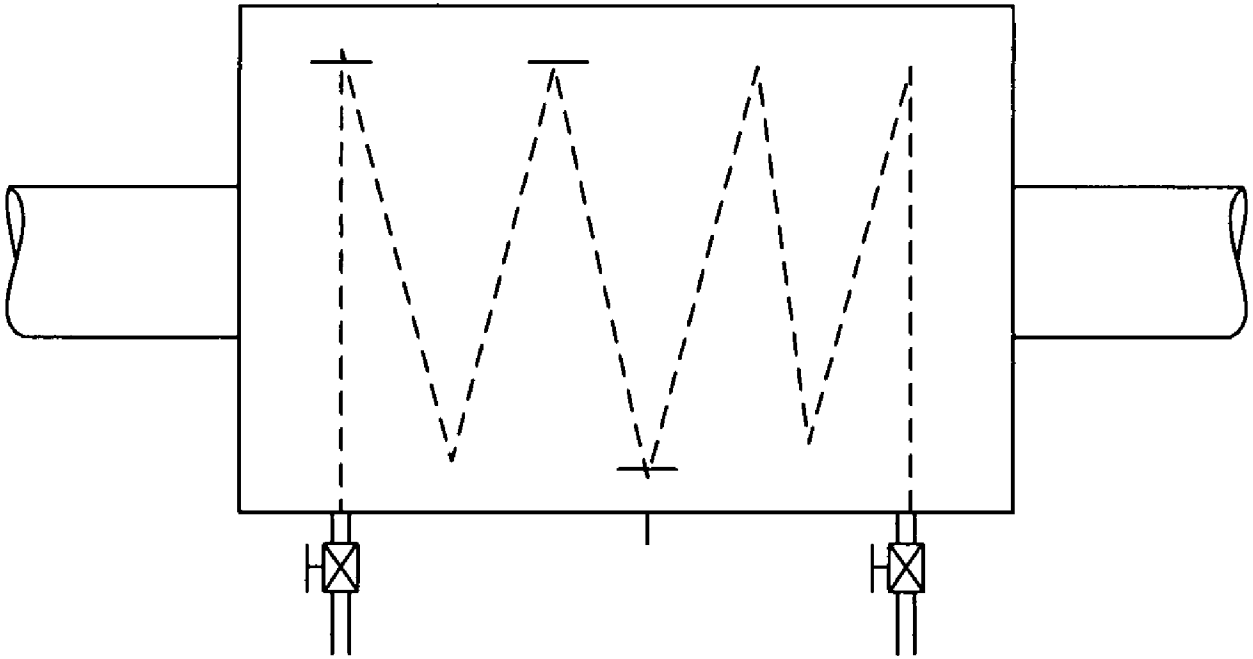
FIG. 16 is a schematic cross section of a pre-chiller usable in certain embodiments of this invention.

Third condenser fluid chamber 10 is coupled to fourth condenser fluid chamber 6, which contains portions of first, second, third, and fourth coolant fluid tubes 31, 35, 38, and 39 and portions of first and second condenser fluid tubes 33 and 37. Fourth fluid chamber 6 may contain at least one baffle 14 separating the fourth fluid chamber 6 into at least two sections. Condenser fluid may flow from one section to another over baffle 14 by moving through cross over 4 as illustrated in FIG. 13. By sending the condenser fluid through fourth condenser fluid chamber 6, the condenser fluid contacts the outside surface of coolant fluid tubes 38 and 39, which allows the condenser fluid to lose additional heat to the coolant fluid flowing through coolant tubes 38 and 39.

The flow path of the condenser fluid is a closed system in which the condenser fluid is not permitted to escape from the system 27. First, the condenser fluid flows from the condenser and is deposited into first condenser fluid chamber 16. The condenser fluid then flows through the first set of condenser fluid tubes 33 surrounding the coolant fluid tubes 31 and into second condenser fluid chamber 36. In this manner, the condenser fluid flows in the space between the outside surfaces of the coolant fluid tubes 31 and the inside surfaces of the condenser fluid tubes 33. The condenser fluid then flows through the second set of condenser fluid tubes 37 and into the third condenser fluid chamber 10. The condenser fluid loses heat while passing through the first and second set of condenser fluid tubes 33 and 37. The condenser fluid then flows into fourth condenser fluid chamber 6, where the fluid flows over outside surfaces of the third set of coolant fluid tubes 38, over baffle 14 by way of cross over 4, and over the outside surfaces of the fourth set of coolant fluid tubes 39. The condenser fluid loses heat while flowing over third and fourth coolant fluid tubes 38 and 39. The condenser fluid then returns from the third condenser fluid chamber 6 to the condenser 1. In one embodiment, the condenser fluid enters first condenser fluid chamber 16 having a temperature no greater than about 95 degrees Fahrenheit (F) at 20 pounds per square inch (psi) and exits fourth condenser fluid chamber 6 at about 85 degrees F. This configuration has a capacity of about 1,280 gallons of condenser fluid; however, this amount may vary depending on the capacity of the air conditioning system coupled to the condenser fluid cooling system 10.

The flow path for the coolant fluid through the condenser fluid cooling chamber 28 is as follows. First, the coolant fluid flows from coolant fluid cooling chamber 29 or coolant storage chamber 76 into first coolant fluid chamber 18. The coolant fluid then flows through the lumens of a first set of coolant fluid tubes 31 into second coolant fluid chamber 34. The coolant fluid then flows through the lumens of a second set of coolant fluid tubes 35 into third coolant fluid chamber 12. The coolant fluid then returns to coolant fluid chamber 29.

If necessary, a valve may permit coolant fluid to flow from coolant fluid chamber 29 or coolant storage chamber 76 to fourth coolant fluid chamber 8, where the coolant fluid contacts the outside surface of the condenser fluid tubes 37 and 39 by flowing through coolant fluid tubes 38 and 39. The coolant fluid flows through fourth coolant fluid chamber 8 and returns to coolant fluid cooling chamber 29.

III. Coolant Fluid Cooling Chamber

Figure 7:
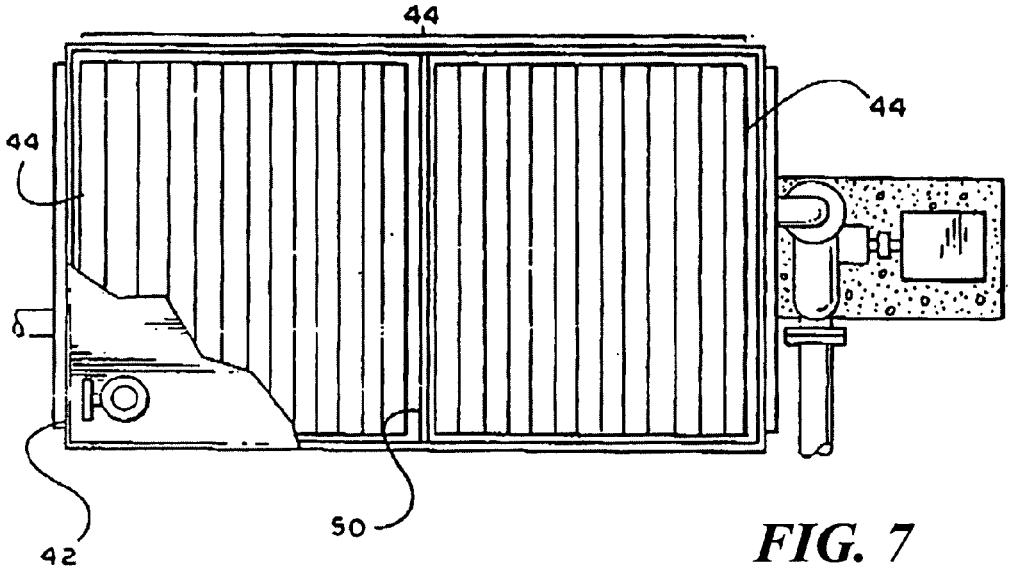
FIG. 7 depicts a top cross-sectional view of the coolant water cooling system shown in FIG. 6.
Figure 8:
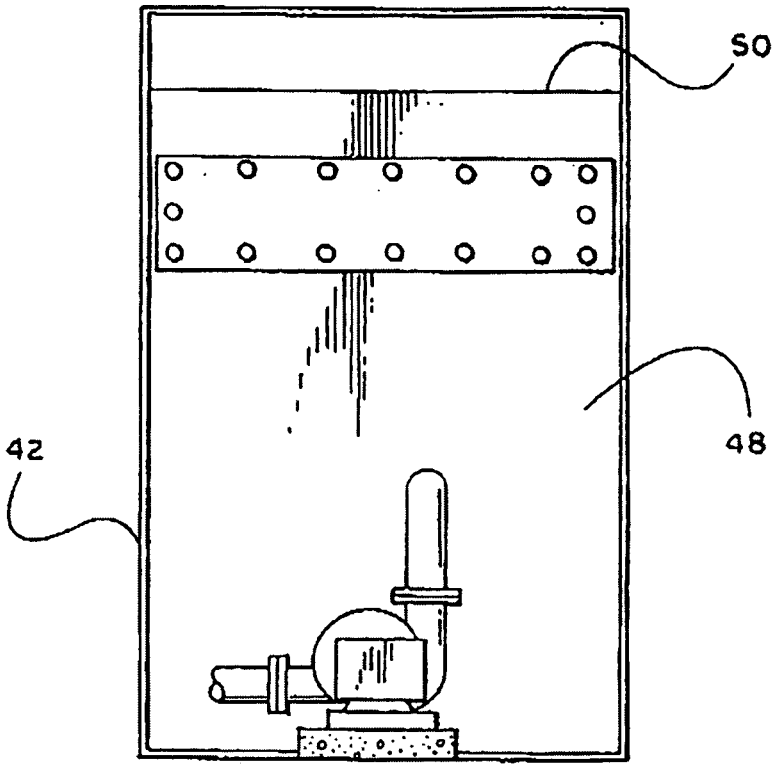
FIG. 8 depicts a right side cross-sectional view of the coolant water cooling system shown in FIG. 6.

Coolant fluid cooling chamber 29 receives a coolant fluid from condenser fluid cooling chamber 28 and extracts heat from the coolant fluid before returning the coolant fluid to the condenser fluid cooling chamber 28. The coolant fluid cooling chamber 29, as shown in FIGS. 6–8, may be any system capable of reducing the temperature of the coolant fluid that is passed through condenser fluid cooling chamber 28.

Figure 6:
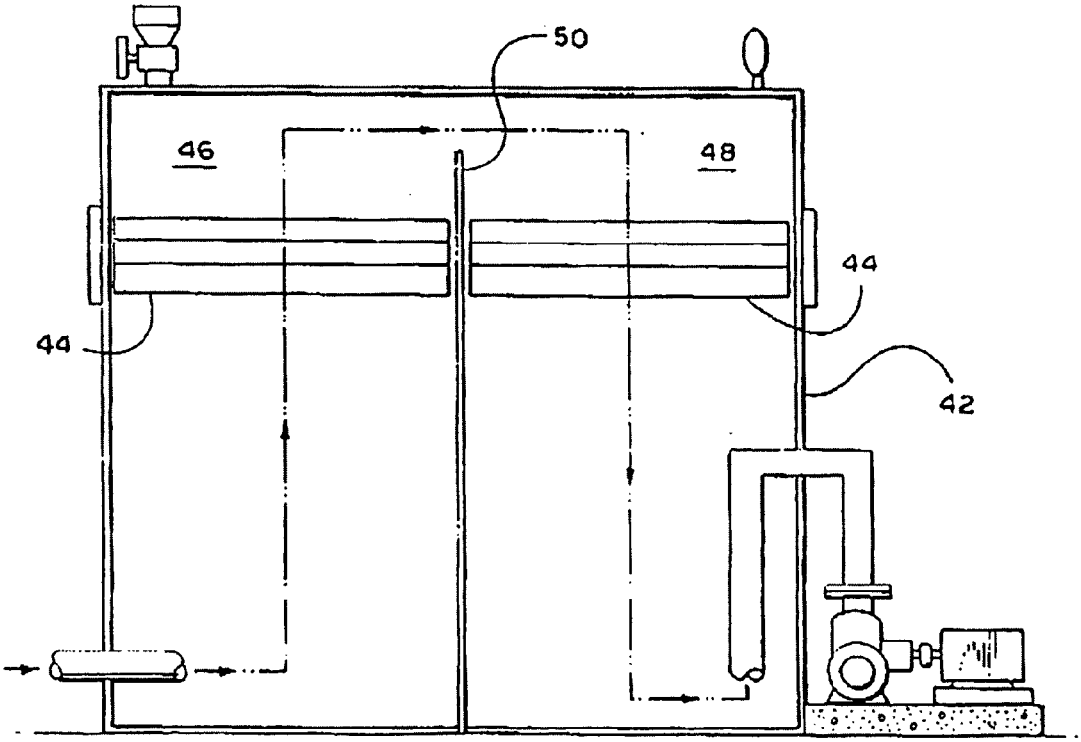
FIG. 6 depicts a front cross-sectional view of a coolant water cooling system usable in certain embodiments of this invention.

In the embodiment shown in FIG. 6, coolant fluid cooling chamber 29 is a dual-pass heat exchanger formed from a tank 42, having a generally rectangular shape, which is divided into a first chamber 46 and a second chamber 48. Tank 42 contains a plurality of tubes 44 through which a refrigerant flows. Tubes 44 are positioned generally parallel to each other, as shown in FIG. 6, and generally perpendicular to the direction of flow of the coolant fluid.

Coolant fluid cooling chamber 29 operates by receiving a coolant fluid in first chamber 46. The coolant fluid fills first chamber 46 until reaching the height of baffle 50. The coolant fluid then flows over baffle 50 and fills second chamber 48. The coolant fluid contacts the tubes 44 while flowing through first chamber 46 and second chamber 48. Heat is extracted from the coolant fluid and received by the refrigerant flowing through tubes 44. The temperature of the coolant fluid exiting second chamber 48 of coolant fluid cooling chamber 29 is less than the temperature of the coolant fluid entering the first chamber 46 of coolant fluid cooling chamber 29. After flowing through the coolant fluid cooling chamber 29, the coolant fluid is sent to a coolant fluid storage tank 76. In one embodiment, coolant fluid storage tank 76 is insulated and has a capacity of about 700 gallons. The coolant fluid is sent from coolant fluid storage tank 76 to the condenser fluid cooling chamber 28, and the refrigerant is returned to cooling system 30.

IV. Cooling System

Cooling system 30 produces a cold refrigerant that is used to reduce the temperature of the coolant fluid in coolant water cooling chamber 29. Cooling system 30 may be any cooling system capable of reducing the temperature of the coolant fluid while not losing fluids to the environment, such as is common in evaporative cooling systems. In one embodiment designed for a capacity of 100 tons, cooling system 30, as shown in FIG. 1, includes four compressors 52, 54, 56 and 58, at least one condenser 60 and at least one expansion valve for reducing the temperature of a refrigerant. Each compressor 52, 54, 56 and 58 may be run by a motor generating about 5 horsepower of power. Under normal operating conditions for a 100 ton air conditioning unit, compressor 52 operates continuously, condenser 54 operates intermittently, and compressor 56 operates in times of heavy loads, such as when the temperature of ambient air is high. Compressor 58 is a backup condenser that is used when compressor 52, 54 or 56 is broken. Compressor 58 alleviates having to shutdown condenser water cooling system 27 and the entire air conditioning system if one of compressors 52–56 quits working.

During operation, the refrigerant is passed through compressors 52, and possibly 54, 56, and/or 58 if needed, to compress the refrigerant gas. The temperature of the refrigerant is increased as it is compressed. The compressed refrigerant is then passed through condenser 60 to reduce the temperature of the refrigerant and to condense the refrigerant. Condenser 60 may be composed of many configurations. In one embodiment, condenser 60 is an air-cooled condenser formed from a plurality of tubes coupled with fins for increasing the efficiency of condenser 60. The air that passed across the fins and tubes of condenser 60 may first be cooled using an air cooler 64, as shown in FIG. 8, to reduce the temperature of the ambient air to increase the efficiency of condenser 60 and system 27. The refrigerant is then sent through expansion valve 62 where the temperature of the refrigerant is further reduced. The refrigerant is passed through tubes 44 in coolant fluid cooling chamber 29 to reduce the temperature of the coolant fluid.

V. Air Cooler

Figure 10:
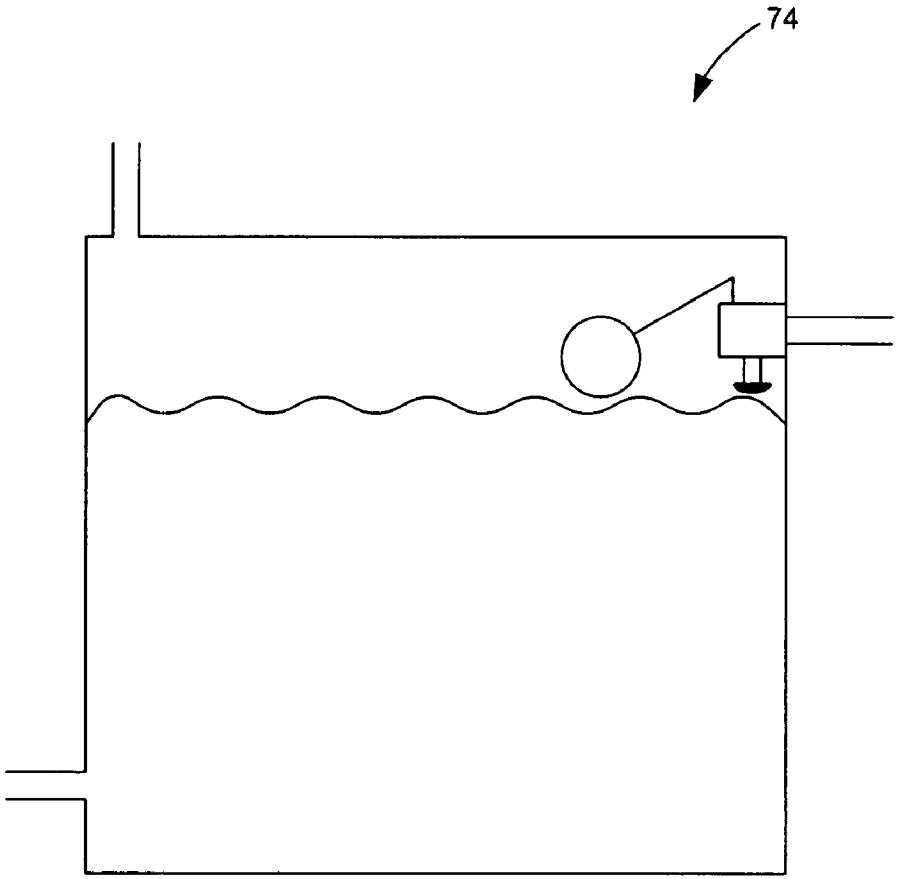
FIG. 10 is a side cross-sectional schematic view of an air cooler water supply tank usable in certain embodiments of this invention.
Figure 11:
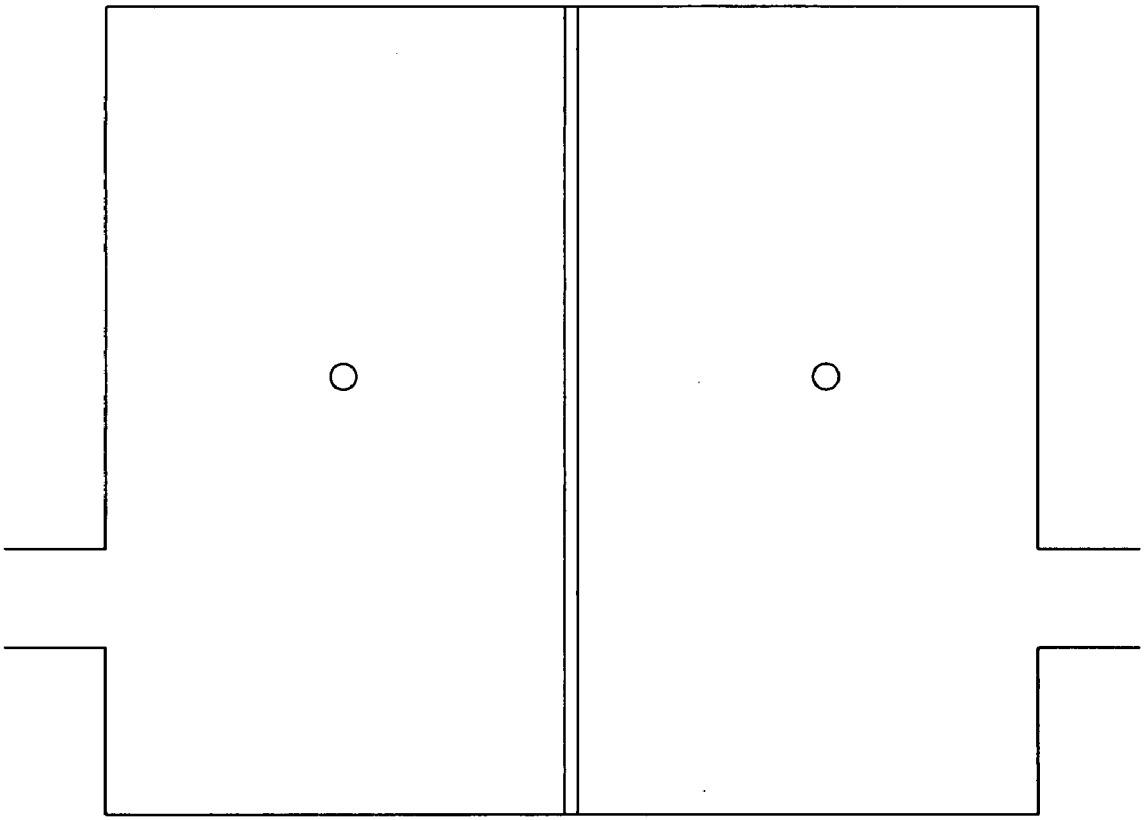
FIG. 11 is a schematic cross section diagram taken along the line A—A in FIG. 2.
Figure 12:
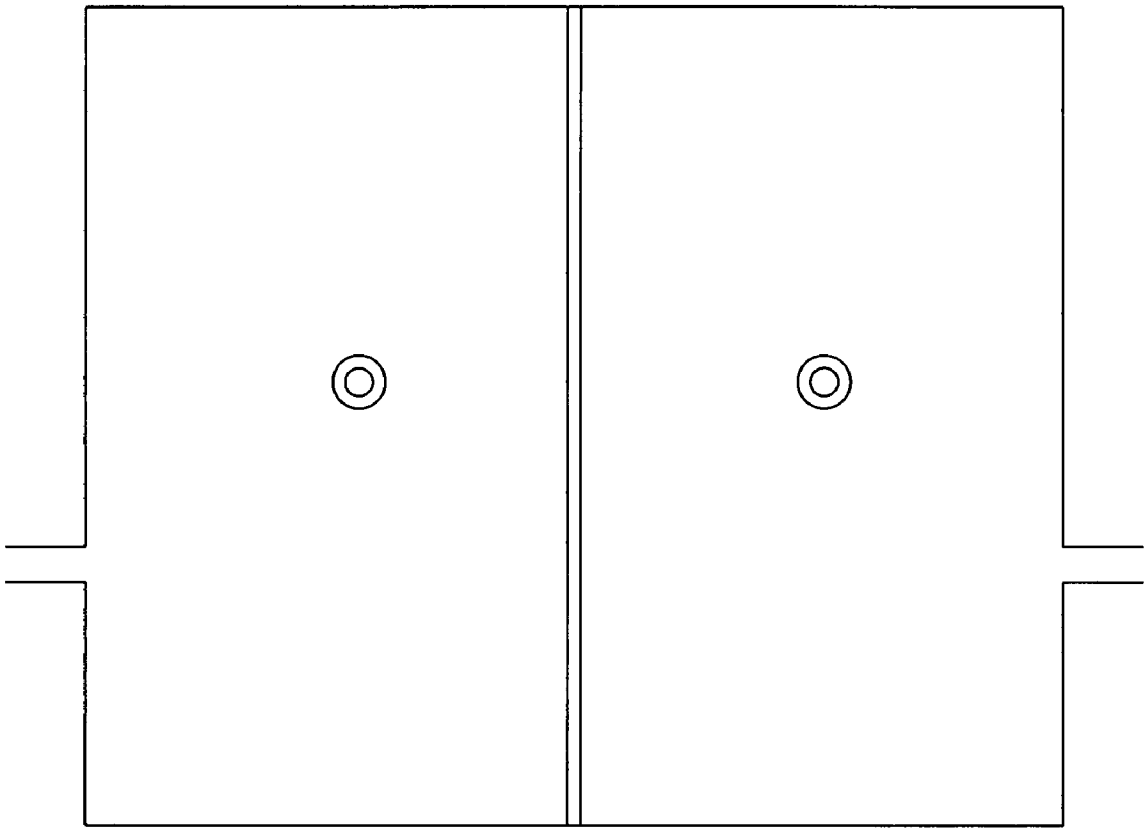
FIG. 12 is a schematic cross section diagram taken along the line B—B in FIG. 2.

Air cooler 64 reduces the temperature of ambient air before being passed through condenser 60 and may be composed of any configuration. In one embodiment, as shown in FIG. 8, air cooler 64 includes at least one drift eliminator for reducing the temperature of the ambient air. In this embodiment, air cooler 64 includes three drift eliminators 66, 68 and 70. Each drift eliminator has a honeycomb design, but in other embodiments may have a blade-type or wave form configuration. The drift eliminators rely on change in direction of air flow to separate the water droplets from the air. The drift eliminators may be formed from materials such as, but not limited to, ceramics, fiber reinforced cement, fiberglass, metal, plastic, such as polyvinyl chloride (PVC), and wood installed or formed into closely spaced slats, sheets, honeycomb assemblies, or tiles. Drift eliminators 66 and 68 may be approximately 4 inches in thickness and receive water at a rate of about 30 gallons per hour flowing generally vertically through conduits in the drift eliminators. Drift eliminators 66 and 68 may be supplied with water from storage tank 74 as shown in FIG. 10. Storage tank 74 may be filled with water obtained from an existing cooling system. Air passes through the numerous openings in the drift eliminators and first passes through drift eliminator 66 and then through drift eliminator 68. Drift eliminator 70 operates to catch any water droplets that may be present in the air coming from drift eliminators 66 and 68. Air cooler 64 reduces the temperature of the ambient air before being passed across the condenser in cooling system 16. Cooling the ambient air in this manner increases the efficiency of the condenser water cooling system 10.

The terms and expressions which have been employed herein are used as terms of description and not of limitation, and there is no intention, in the use of such terms and expressions, of excluding any equivalents of the features shown and described or portions thereof. Having thus described the invention in detail, it should be apparent that various modifications can be made in the present invention without departing from the spirit and scope of the following claims.

I claim:

1. A system for reducing the temperature of a condenser fluid used in a condenser of an air conditioning system, comprising:

a first heat exchanger for receiving the condenser fluid from the condenser and reducing the temperature of the condenser fluid using a coolant fluids;

a second heat exchanger for reducing the temperature of the coolant fluid received from the first heat exchanger by passing the coolant fluid across a plurality of tubes through which a refrigerant flows and for returning the coolant fluid to the first heat exchanger; and at least one cooling unit for reducing the temperature of the refrigerant to a temperature less than a temperature of the coolant fluid;

wherein the first heat exchanger comprises a multi-pass heat exchanger, comprising:

a plurality of concentric tubes configured to pass the condenser fluid between an outside surface of at least one inner tube and an inside surface of at least one outer tube and to pass the coolant fluid through a lumen of the at least one inner tube and to contact the coolant fluid with the outside surface of the at least one outer tube.

2. The system of claim 1, further comprising a plurality of baffles positioned in the first heat exchanger to increase contact of the coolant fluid with the outside surface of the at least one outer tube.

3. A system for reducing the temperature of a condenser fluid used in a condenser of an air conditioning system, comprising:

a first heat exchanger for receiving the condenser fluid from the condenser and reducing the temperature of the condenser fluid using a coolant fluid;

a second heat exchanger for reducing the temperature of the coolant fluid received from the first heat exchanger by passing the coolant fluid across a plurality of tubes through which a refrigerant flows and for returning the coolant fluid to the first heat exchanger; and at least one cooling unit for reducing the temperature of the refrigerant to a temperature less than a temperature of the coolant fluid;

wherein the second heat exchanger comprises a dual-pass heat exchanger.

4. A method for extracting heat from a condenser fluid used in a condenser of an air conditioning system, comprising:

sending a condenser fluid used in the condenser to a first heat exchanger to reduce the temperature of the condenser fluid using a coolant fluid;

sending the coolant fluid to a second heat exchanger to reduce the temperature of the coolant fluid received from the first heat exchanger by passing the coolant fluid across a plurality of tubes through which a refrigerant flows;

returning the condenser fluid to the condenser; and sending the refrigerant to at least one cooling unit to reduce the temperature of the refrigerant to a temperature less than a temperature of the coolant fluid;

wherein sending the condenser fluid used in the condenser to the first heat exchanger to reduce the temperature of the condenser fluid using a coolant fluid comprises:

passing the coolant fluid between an outside surface of at least one inner tube and an inside surface of at least one outer tube;

passing the coolant fluid through a lumen of at least one inner tube; and passing the coolant fluid through the first heat exchanger and in contact with an outside surface of the at least one outer tube.

5. The method of claim 4, wherein the inner and outer tubes comprise star shaped cross-sections.

6. The method of claim 4, wherein the inner and outer tubes comprise cross shaped cross-sections.

7. A system for reducing the temperature of a condenser fluid used in a condenser of an air conditioning system, comprising:

(a) a first heat exchanger for receiving the condenser fluid from the condenser and reducing the temperature of the condenser fluid using a coolant fluid, wherein the first heat exchanger comprises a dual-pass heat exchanger comprising a plurality of concentric tubes configured to pass the condenser fluid between an outside surface of at least one inner tube and an inside surface of at least one outer tube and to pass the coolant fluid through a lumen of the at least one inner tube and to contact the coolant fluid with the outside surface of the at least one outer tube;

(b) a second heat exchanger for reducing the temperature of the coolant fluid received from the first heat exchanger by passing the coolant fluid across a plurality of tubes through which a refrigerant flows and for returning the coolant fluid to the first heat exchanger; and (c) at least one cooling unit for reducing the temperature of the refrigerant to a temperature less than a temperature of the coolant fluid.

8. The system of claim 7, further comprising a plurality of baffles positioned in the first heat exchanger to increase contact of the coolant fluid with the outside surface of the at least one outer tube.

9. A system for reducing the temperature of a condenser fluid used in a condenser of an air conditioning system, comprising:

(a) a first heat exchanger for receiving the condenser fluid from the condenser and reducing the temperature of the condenser fluid using a coolant fluid, wherein the first heat exchanger comprises:

(i) a chamber containing a plurality of concentric tubes formed by at least one inner tube positioned concentrically within at least one outer tube;

(ii) wherein the cross sections of the inner and outer tubes are selected from a group consisting of star shaped cross-sections and cross shaped cross-sections;

(b) a second heat exchanger for reducing the temperature of the coolant fluid received from the first heat exchanger by passing the coolant fluid across a plurality of tubes through which a refrigerant flows and for returning the coolant fluid to the first heat exchanger; and (c) at least one cooling unit for reducing the temperature of the refrigerant to a temperature less than a temperature of the coolant fluid.

10. A method for extracting heat from a condenser fluid used in a condenser of an air conditioning system, comprising:

(a) sending a condenser fluid used in a condenser to a first heat exchanger to reduce the temperature of the condenser fluid using a coolant fluid, comprising:

(i) passing the coolant fluid between an outside surface of at least one inner tube and an inside surface of at least one outer tube;

(ii) passing the coolant fluid through a lumen of at least one inner tube; and (iii) passing the coolant fluid through the first heat exchanger and in contact with an outside surface of the at least one outer tube;

(b) sending the coolant fluid to a second heat exchanger to reduce the temperature of the coolant fluid received from the first heat exchanger by passing the coolant fluid across a plurality of tubes through which a refrigerant flows;

(c) returning the condenser fluid to the condenser; and (d) sending the refrigerant to at least one cooling unit to reduce the temperature of the refrigerant to a temperature less than a temperature of the coolant fluid.

11. The method of claim 10, where in the inner and outer tubes comprise star shaped cross-sections.

12. The method of claim 10, wherein the inner and outer tubes comprise cross shaped cross-sections.

* * * * *